US008697999B2

(12) United States Patent
Thiem

(10) Patent No.: US 8,697,999 B2
(45) Date of Patent: Apr. 15, 2014

(54) ELECTRIC INSULATOR

(76) Inventor: Wayne R. Thiem, Bozeman, MT (US)

( * ) Notice: Subject to any disclaimer, the term of this patent is extended or adjusted under 35 U.S.C. 154(b) by 119 days.

(21) Appl. No.: 13/399,007

(22) Filed: Feb. 17, 2012

(65) Prior Publication Data

US 2012/0210561 A1 Aug. 23, 2012

Related U.S. Application Data

(60) Provisional application No. 61/444,582, filed on Feb. 18, 2011.

(51) Int. Cl.
*H01B 17/16* (2006.01)

(52) U.S. Cl.
USPC ..... 174/161 F; 174/158 F; 174/163 F; 174/72 A; 256/10; 248/74.1

(58) Field of Classification Search
USPC ..... 174/158 F, 161 F, 163 F, 72 A; 256/10; 248/74.1
See application file for complete search history.

(56) References Cited

U.S. PATENT DOCUMENTS

| | | | | |
|---|---|---|---|---|
| 541,332 | A | | 6/1895 | Patterson |
| 1,206,812 | A | | 12/1916 | Callaway |
| 2,814,669 | A | | 11/1957 | Reginald |
| 2,865,609 | A | | 12/1958 | Steiner |
| 2,921,115 | A | | 1/1960 | Wilson |
| 3,136,202 | A | | 6/1964 | Wagner |
| 3,250,517 | A | | 5/1966 | Anthony |
| 3,669,413 | A | | 6/1972 | Laible |
| 3,742,123 | A | | 6/1973 | Haub, Jr. |
| 4,028,489 | A | | 6/1977 | Berg, Jr. et al. |
| 4,046,356 | A | | 9/1977 | Rose |
| 4,049,905 | A | * | 9/1977 | Maranell ..... 174/163 F |
| 4,061,873 | A | | 12/1977 | Berg, Jr. et al. |
| 4,150,814 | A | | 4/1979 | Warren et al. |
| 4,243,343 | A | | 1/1981 | Wier |
| 4,263,477 | A | | 4/1981 | Wilson, Sr. |
| 4,318,088 | A | | 3/1982 | Hunter |
| 4,580,767 | A | | 4/1986 | Zimmerman |
| 4,599,488 | A | | 7/1986 | Wilson, Jr. |
| 4,623,756 | A | | 11/1986 | Wilson, Jr. |
| 4,680,428 | A | | 7/1987 | Wilson, Jr. |
| 4,771,137 | A | | 9/1988 | Thompson |
| 4,866,218 | A | | 9/1989 | Wilson, Jr. |

(Continued)

FOREIGN PATENT DOCUMENTS

| | | |
|---|---|---|
| FR | 2475810 | 8/1981 |

OTHER PUBLICATIONS

West Virginia Fence Corp., MAX-FLEX™ Fence Superlife Insulators, http://maxflex.com/Insulators.HTM, printed Feb. 2, 2011, pp. 1-2.

(Continued)

*Primary Examiner* — Dhirubhai R Patel
(74) *Attorney, Agent, or Firm* — Sheridan Ross P.C.

(57) ABSTRACT

An electric insulator is provided that can be used between an electrified wire of an electric fence and a fence post. The electric insulator generally includes a body having a lateral aperture. The lateral aperture extends for the entire length of the body and is configured to allow a wire to be laterally inserted into, or removed from, a central channel of the electric insulator. The electric insulator may include one or more fins to assist in securing the electric insulator to a fence post.

18 Claims, 4 Drawing Sheets

(56) References Cited

U.S. PATENT DOCUMENTS

| | | | |
|---|---|---|---|
| 4,883,923 | A | 11/1989 | Langlie et al. |
| 4,905,968 | A | 3/1990 | Eby et al. |
| 4,965,413 | A | 10/1990 | Langlie et al. |
| 5,032,693 | A | 7/1991 | Langlie et al. |
| 5,920,036 | A | 7/1999 | Egger |
| 5,959,255 | A | 9/1999 | Langlie et al. |
| 6,209,853 | B1 | 4/2001 | Roy et al. |
| 6,239,377 | B1 | 5/2001 | Nishikawa |
| 6,489,569 | B1 | 12/2002 | Thomson |
| D474,152 | S | 5/2003 | Burdick |
| 6,563,055 | B1 | 5/2003 | Burdick |
| 6,960,728 | B1 | 11/2005 | Halderman |
| 2010/0089618 | A1 | 4/2010 | Clippinger |

OTHER PUBLICATIONS

Kencove Farm Fence Supplies, Insultube 50 ft Roll, http://www.kencove.com/fence/Insultube_detail_G05.php, printed Feb. 2, 2011, pp. 1-2.

* cited by examiner

ELECTRIC INSULATOR

CROSS-REFERENCE TO RELATED APPLICATIONS

This application claims the benefit of U.S. Provisional Application Ser. No. 61/444,582, filed Feb. 18, 2011, the entire disclosure of which is hereby incorporated herein by reference.

FIELD

The present invention relates to an insulator for use at an interface between an electrical conductor and another element. In exemplary embodiments, the insulator can be used between an electrified wire of an electric fence and a fence post.

BACKGROUND

Electrically charged fencing is often used to fence in animals, or to prevent animals from accessing certain areas. In order to provide insulation between electrified wires and support posts, dielectric brackets can be used. However, such brackets are prone to breakage, and can be expensive. As an alternative, tubular insulators are available. However, such tubular insulators require that each insulator be threaded onto the associated wire. This can result in a time consuming and inconvenient process, particularly where long runs of fencing are being installed, or where existing fencing is being repaired. It can also be desirable to add insulation to other electrical conductors. For example, vehicle trailers often include wiring that is exposed and prone to damage. In order to repair or protect such systems, tape can be applied. However, tape can be messy and unreliable. As another example, heat shrink tubing can be placed over wires and/or connectors. However, the use of such tubing requires that wires be broken or disconnected in order to place the wire in the tubing.

SUMMARY

Embodiments of the present invention generally provide an electric insulator or sleeve having a lateral aperture formed therein. The lateral aperture allows the insulator to be installed on, or removed from, a wire, without requiring access to the ends of that wire or requiring the insulator to be cut in the field, which can result in severe bodily injury. The lateral aperture can have a coiled or spiral form, such that the edges of the insulator body overlap. As a result, when the insulation is installed on a wire and attached to a fencepost, no portion of the wire is exposed, insuring that the wire remains electrically insulated from the support post and/or fasteners.

In accordance with further embodiments of the present invention, an electric insulator that includes a pair of lateral fins is provided. The fins generally protrude from opposite sides of the insulator body. Moreover, the fins generally protrude for a distance that is sufficient to allow one or both fins to be intercepted by a fastener, for example to better secure the insulator against a fence post.

Additional features and advantages of embodiments of the present invention will become more readily apparent from the following description, particularly when taken together with the accompanying drawings.

DETAILED DESCRIPTION

Figure 1:
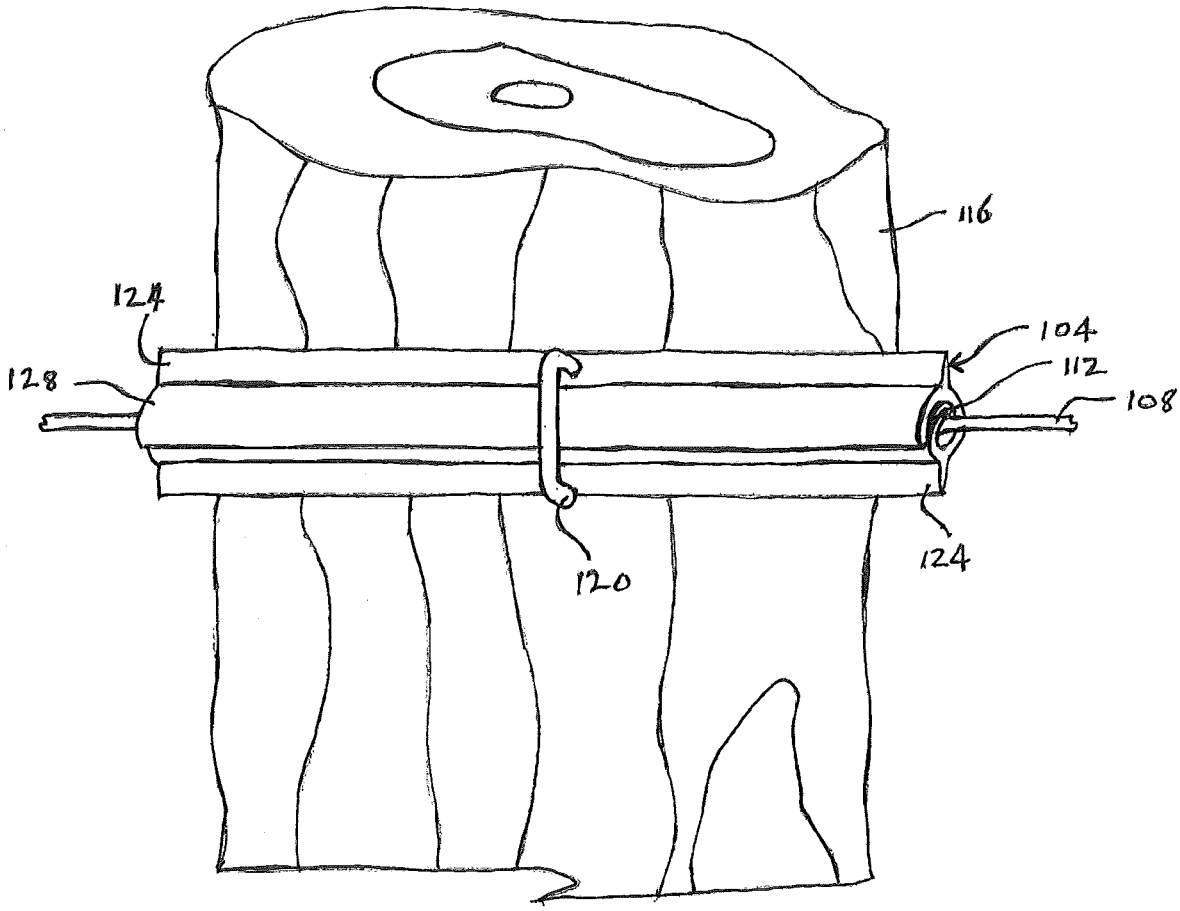
FIG. 1 illustrates an electric insulator in accordance with embodiments of the present invention, and an associated fence wire and fence post.

FIG. 1 illustrates an electric insulator 104 in accordance with embodiments of the present invention, in an exemplary embodiment. In particular, a high tensile, electrified wire 108 is shown extending through the central channel 112 of the electric insulator 104. The electric insulator 104 is secured to a fence post 116 by a fastener, in this example a staple 120. The staple 120 intersects fins 124 that protrude from opposite sides of the body 128 of the electric insulator 104.

Figure 2:
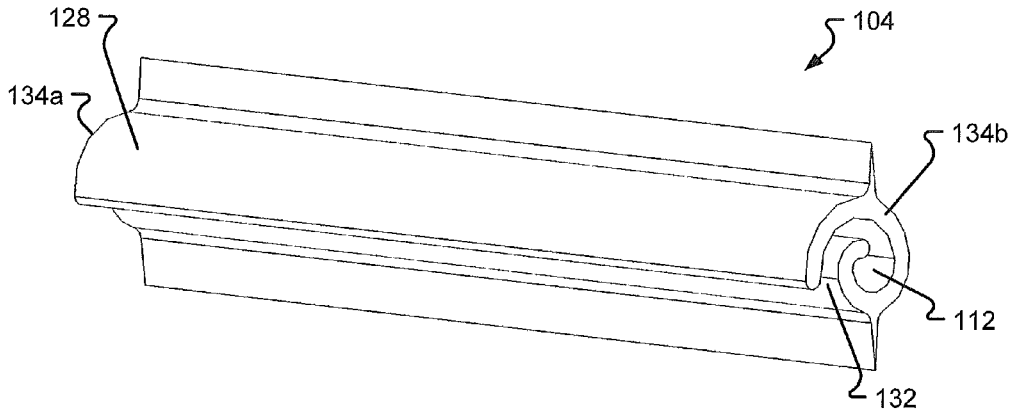
FIG. 2 is a perspective view of an electric insulator in accordance with embodiments of the present invention.

FIG. 2 is an illustration of an electric insulator 104 in accordance with embodiments of the present invention, in a perspective view. In general, the electric insulator 104 includes a body 128 in which a lateral aperture 132 is formed. The lateral aperture 132 extends for the entire length of the electric insulator body 128, from a first end 134*a* to a second end 134*b*. Moreover, the lateral aperture 132 provides access to the central channel 112 of the electric insulator 104. Accordingly, a wire 108 of an electric fence (see FIG. 1) can be placed within the central channel 112 via the lateral aperture 132. The electric insulator 104 can therefore be placed over, or removed from, a fence wire 108, without requiring access to an end of that wire 108 or requiring the electric insulator 104 to be cut in the field.

Figure 3A:
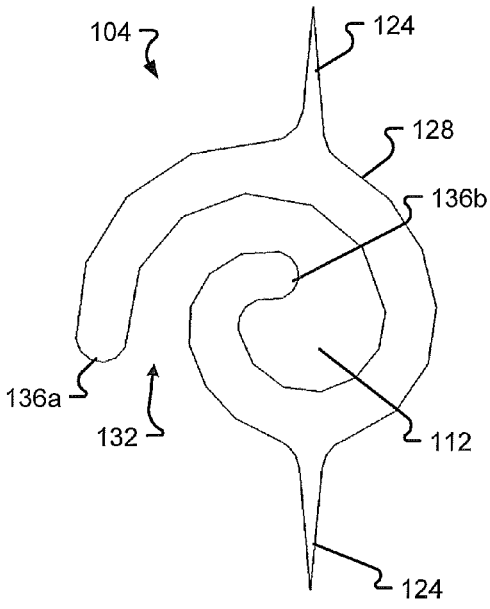
FIGS. 3A-3B are end views of an electric insulator in accordance with embodiments of the present invention.
Figure 3B:
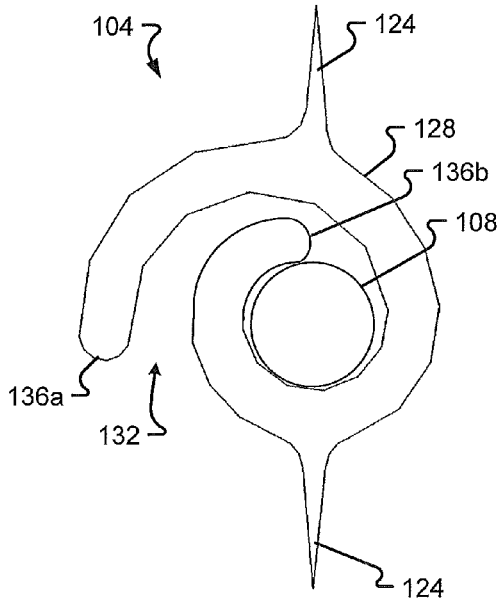

FIG. 3A is an end view of an electric insulator 104 in accordance with embodiments of the present invention. As can be seen in this view, the lateral edges 136*a* and 136*b* of the electric insulator body 128 overlap one another. This configuration ensures that a fastener 120 or post 116 will remain electrically insulated from a fence wire 108 held within the central channel 112 of the electric insulator 104. Moreover, as shown in the figure, the lateral edges 136*a* and 136*b* define an aperture 132 that describes a spiral shaped path between an exterior of the body 128 and the central channel 112. The spiral shaped path depicted in FIG. 3 has a substantially constant width. In alternative embodiments, the aperture 132 includes a spiral shaped path with a varying width. For example, in one configuration, the width of the spiral shaped path decreases from the exterior of the body 128 to the central channel 112. The larger width near the exterior of the body 128 allows easier insertion of a wire 108 into the lateral aperture 132, while the smaller width near the central channel 112 insures the wire 108 is not inadvertently dislodged from the central channel 112. For example, the larger width near the exterior of the body 128 may be larger than a diameter of a wire 108, while the smaller width near the central channel 112 may be smaller than the diameter of the wire 108. In another configuration, the width of the spiral shaped path near the exterior of the body 128 is smaller than the width of the spiral shaped path near the central channel 112. In a further configuration, no gap is provided between the lateral edges 136*a* and 136*b*. In these alternative embodiments, the lateral edges 136*a*, 136*b* are elastically deformed when inserting the wire 108 into the central channel 112. After the wire 108 is placed in the central channel 112, the lateral edges 136*a*, 136*b* elastically return to their initial positions to secure the wire 108 within the central channel 112. FIG. 3B is an end view of an electric insulator 104 with a wire 108 inserted into a central channel 112, in accordance with embodiments of the present invention. In the depicted embodiment, the lateral end 136*b* has been displaced to accommodate the wire 108. In this embodiment, the displaced lateral end 136*b* retains the wire 108 in the central channel 112. In accordance with embodiments of the present invention, an electric insulator 104 can accommodate a range of wire diameters, some of which will not displace the lateral end 136*b* when disposed in the central channel 112.

In accordance with embodiments of the present invention, one or more fins may protrude from an exterior surface of the body 128 of the electric insulator 104. In one embodiment, fins 124 protrude from opposite sides of the body 128 of the electric insulator 104. For example, in one embodiment, a first fin member 124 protrudes from a first side of the body 128 of the electric insulator 104, and a second fin member 124 protrudes from a second side of the body 128 of the electric insulator 104. In accordance with embodiments of the present invention, a large range of fin sizes may be provided. For example, in one embodiment, the fins 124 may each protrude from the body 128 for a distance that is no less than half an outside diameter of the body 128. When the electric insulator 104 is installed, the fins 124 provide a surface that can be intercepted by the fastener 120 used to secure the electric insulator 104 and the associated wire 108 to a support post 116. This helps to secure the electric insulator 104 to prevent movement of the electric insulator 104 along the wire 108, and away from the post 116.

Figure 4:
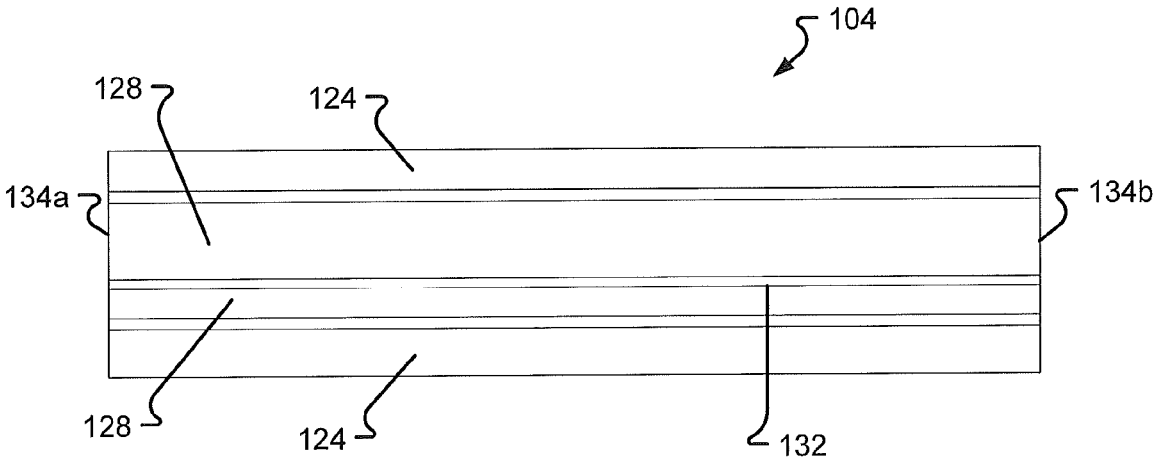
FIG. 4 is a side elevation view of an electric insulator in accordance with embodiments of the present invention.

FIG. 4 is a side elevation view of an electric insulator 104 in accordance with embodiments of the present invention. In addition, the electric insulator 104 is shown from an aperture 132 or open side. In accordance with embodiments of the present invention, the electric insulator 104 may be provided in discrete lengths. For example, in one embodiment, the electric insulator 104 is provided in discrete lengths of four inches, six inches, eight inches, ten inches, or twelve inches. In alternative embodiments, the electric insulator 104 may be associated with a reel and cut to desired lengths. For example, in one embodiment, a reel includes an electric insulator 104 having a length of twenty-five feet, fifty feet, or one-hundred feet.

Figure 5:
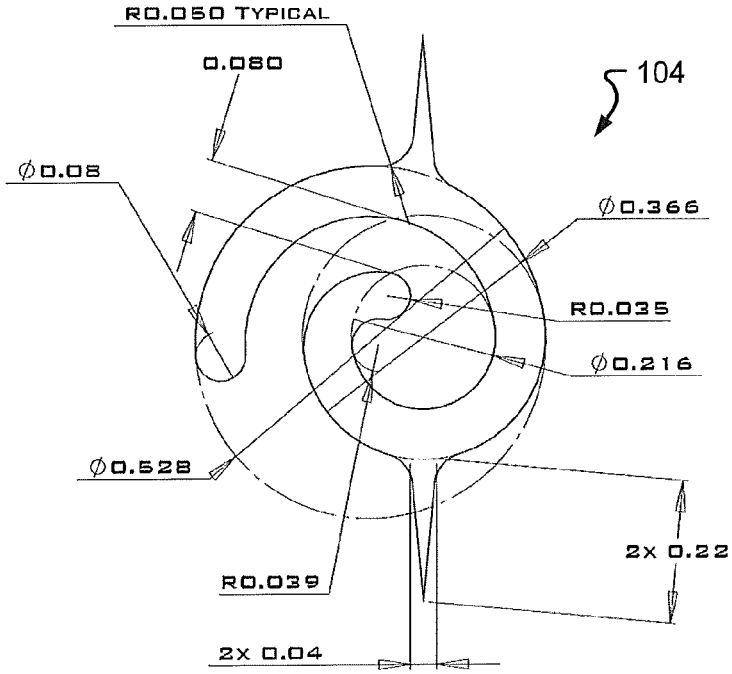
FIG. 5 is an end view of an electric insulator in accordance with embodiments of the present invention, with exemplary dimensions shown.

FIG. 5 is an end view of the electric insulator 104, with exemplary dimensions of various features included. The units of the dimensions are in inches. In the illustrated example, the nominal wire size that can be accommodated is 12.5 gauge, although a range of wire diameters can be accommodated. As can be appreciated by one of skill in the art after consideration of the present disclosure, differently dimensioned electric insulators 104 can be provided for different wire gauges. In addition, different lengths of electric insulators 104 can be provided for different applications. For example, about a 4 inch length is typical for insulating at an intermediate fence post, while about a 10 inch or longer length might be used where the wire is wrapped around an end post or brace.

Figure 6:
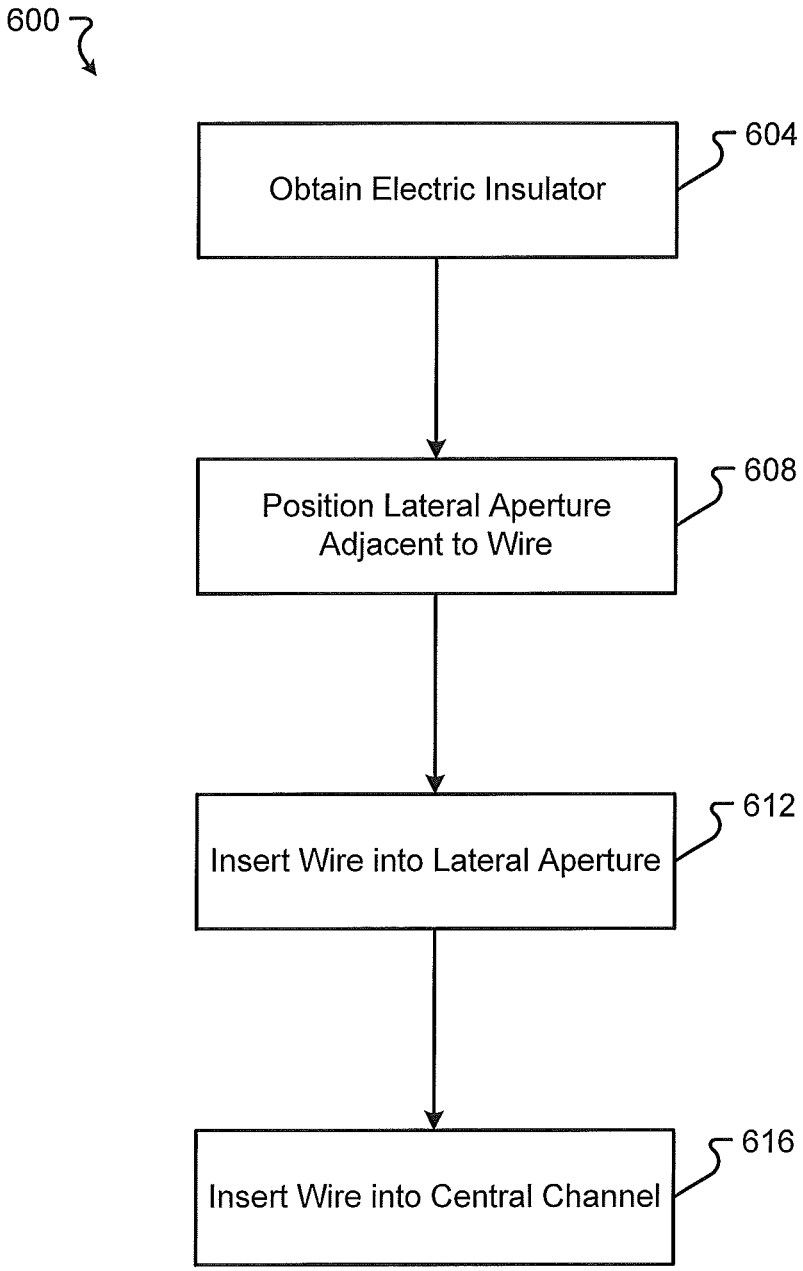
FIG. 6 is a flowchart illustrating a method of insulating a fence wire in accordance with embodiments of the present invention.

FIG. 6 illustrates a method 600 of insulating a wire 108 in accordance with embodiments of the present invention. At step 604, an electric insulator 104 is obtained. In one embodiment, the electric insulator 104 comprises a central channel 112 and a body 128 having two lateral edges 136*a* and 136*b* that define a lateral aperture 132. The lateral aperture 132 may extend the entire length of the body 128, from a first end 134*a* to a second end 134*b*. In addition, the lateral aperture 132 may describe a spiral shaped path between an exterior of the body 128 and the central channel 112. An optional step includes cutting the electric insulator 104 to a predetermined length. At step 608, the lateral aperture 132 is positioned adjacent to the wire 108. At step 612, the wire 108 is inserted into the lateral aperture 132. The wire 108 may deform the lateral edges 136*a* and 136*b* of the body 128 upon insertion of the wire 108 into the lateral aperture 132. At step 616, the wire 108 is inserted into the central channel 112 of the electric insulator 104. In one embodiment, a middle portion of the wire 108 is inserted into the central channel 112 without access to the ends of the wire 108. Once inserted into the central channel 112, the wire 108 may deform the lateral edge 136*b* outwardly. An optional step includes securing the electric insulator 104 to a fence post 116.

An electric insulator 104 in accordance with embodiments of the present invention can be formed from a dielectric material. In addition, the electric insulator 104 can be formed from a pliable or flexible material. In an exemplary embodiment, the electric insulator 104 is formed from a high density polyethylene (HDPE). Moreover, the HDPE can include an additive for improved UV resistance. In accordance with still other embodiments, the electric insulator 104 is formed from UV stable ultra high molecular weight polyethelene (UHMW-PE). An extrusion process can be used to form the electric insulator 104, and they can be cut to a desired length.

Although various examples have been given of an electric insulator 104 comprising an electric fence insulator, embodiments of the present invention are not limited to use in connection with electric fencing. For example, an electric insulator 104 in accordance with embodiments of the present invention can be used in connection with any electrical conductor. In accordance with still other embodiments, the electric insulator 104 can be formed from material that provides electrical insulation, and that shrinks in diameter when heated. In addition, an electrical insulator 104 in accordance with embodiments of the present invention does not require the inclusion of fins, for example where the tubing is not used in connection with an enveloping fastener. Accordingly, the electrical insulator 104 can comprise a body 128 with a lateral aperture 132 formed therein. Moreover, the lateral edges 136*a* and 136*b* of the electric insulator body 128 can overlap one another by an amount sufficient to prevent a gap along the lateral edge when a wire is placed in the channel 112, and heat has been applied to shrink the body 128 about the wire. In addition, an electric insulator 104 in accordance with embodiments of the present invention can be used to protect and envelope ribbon conductors or other wires or conductors that are not round in cross-section, and connectors between electrical conductors. Moreover, use of embodiments of the present invention is not limited to the insulation of electrical conductors. For example, embodiments of the present invention can be used to protect wires or connectors from abrasion or moisture.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. An electric insulator, comprising:

a body having an exterior, a length extending from a first end of the body to a second end of the body, and two lateral edges that define a lateral aperture, wherein the two lateral edges and the lateral aperture extend for the length of the body, and wherein the two lateral edges overlap one another;

a central channel extending the length of the body accessible through any one of the first end of the body, the second end of the body, and the lateral aperture, wherein the lateral aperture describes a spiral shaped path between the exterior of the body and the central channel;

a first fin member protruding from a first side of the body; and a second fin member protruding from a second side of the body, wherein the first fin member and the second fin member extend the length of the body.

2. The electric insulator of claim 1, wherein a distance between a lateral edge of the first fin member and a lateral edge of the second fin member is constant for all of the length of the body.

3. The electric insulator of claim 2, wherein the first fin member and the second fin member protrude from the exterior of the body for a distance that is no less than half an outside diameter of the body.

4. The electric insulator of claim 2, wherein the length of the body is greater than the distance between the lateral edges of the fin members.

5. The electric insulator of claim 1, wherein the electric insulator is formed from a high density polyethylene.

6. The electric insulator of claim 1, wherein the electric insulator is formed from a material that shrinks when subjected to heat.

7. The electric insulator of claim 1, wherein the spiral shaped path has a substantially constant width.

8. The electric insulator of claim 1, wherein the spiral shaped path has a width that decreases from the exterior of the body to the central channel.

9. An electric insulator, comprising:

a body having a length extending from a first end of the body to a second end of the body, two lateral edges, and a lateral aperture formed in the body between the two lateral edges, wherein the lateral aperture extends for the length of the body;

a central channel extending the length of the body accessible through any one of the first end of the body, the second end of the body, and the lateral aperture; and a first fin member and a second fin member protruding from opposite sides of the body, wherein the first fin member and the second fin member extend the length of the body.

10. The electric insulator of claim 9, wherein the lateral edges of the body overlap at the lateral aperture.

11. The electric insulator of claim 10, wherein the lateral aperture describes a spiral shaped path between an exterior of the body and the central channel.

12. The electric insulator of claim 11, wherein the spiral shaped path has a substantially constant width.

13. The electric insulator of claim 11, wherein the spiral shaped path has a width that decreases from the exterior of the body to the central channel.

14. The electric insulator of claim 9, wherein a distance between a lateral edge of the first fin member and a lateral edge of the second fin member is constant over the length of the body.

15. The electric insulator of claim 14, wherein the first fin member and the second fin member protrude from the exterior of the body for a distance that is no less than half an outside diameter of the body.

16. The electric insulator of claim 9, wherein the electric insulator is formed from a high density polyethylene.

17. The electric insulator of claim 9, wherein the electric insulator is formed from a material that shrinks when subjected to heat.

18. A method of insulating a fence wire from a fence post, the method comprising:

providing an electric insulator in a selected length, the electric insulator comprising a central channel, a body having two lateral edges that define a lateral aperture, and fins protruding from opposite sides of the body, the lateral aperture extending an entire length of the body, the central channel accessible through the lateral aperture, the central channel and the fins extending the length of the body;

positioning the lateral aperture adjacent to the fence wire;

inserting the fence wire into the lateral aperture;

inserting the fence wire into the central channel of the electric insulator; and securing the electric insulator to the fence post using a fastener, wherein the fastener intersects at least one of the fins.

* * * * *